US006923550B2

(12) United States Patent
Lee

(10) Patent No.: US 6,923,550 B2
(45) Date of Patent: Aug. 2, 2005

(54) INNOVATED FLASHING DECORATIVE ARTICLE

(76) Inventor: Ching-Hui Lee, P.O. Box 590, Taichung City (TW), 400

( * ) Notice: Subject to any disclaimer, the term of this patent is extended or adjusted under 35 U.S.C. 154(b) by 95 days.

(21) Appl. No.: 10/443,906

(22) Filed: May 23, 2003

(65) Prior Publication Data

US 2004/0057230 A1 Mar. 25, 2004

(30) Foreign Application Priority Data

Sep. 21, 2002 (CN) ..... 02249239 U

(51) Int. Cl.[7] ..... F21L 4/00

(52) U.S. Cl. ..... 362/191; 362/202; 362/398; 362/800

(58) Field of Search ..... 362/191, 202, 362/203, 398, 545, 800

(56) References Cited

U.S. PATENT DOCUMENTS 5,465,197 A * 11/1995 Chien ..... 362/202
6,341,874 B1 * 1/2002 Rubin ..... 362/800
6,547,412 B2 * 4/2003 Piparo-Haase et al. ..... 362/202

* cited by examiner

*Primary Examiner*—Stephen F. Husar
(74) *Attorney, Agent, or Firm*—Rosenberg, Klein & Lee

(57) ABSTRACT

An innovated flashing decorative article, comprising of an upper hollow pipe, a lower hollow pipe and an exterior magnet. The upper hollow pipe has an exterior pipe thread at its lower part meanwhile at the upper part has a circuit board, on the circuit board are IC and LED; the lower hollow pipe has an interior pipe thread, at the bottom of the lower hollow pipe is a magnet, the upper and lower hollow pipes are screwed together by the pipe threads, inside the pipes has battery; the exterior magnet is independently installed outside the upper and lower hollow pipes. The product is compact to carry and easy to use.

3 Claims, 2 Drawing Sheets

INNOVATED FLASHING DECORATIVE ARTICLE

BACKGROUND OF THE INVENTION (a) Field of the Invention

The present invention relates to an innovated flashing decorative article.

(b) Description of the Prior Art

Most conventional decorative articles are without flashing light and lack of amusement effect. Though a few decorative articles may have light flashing function, they will not function until they are switched on. Therefore, the additional switch complicates the construction of the product.

BRIEF DESCRIPTION OF THE INVENTION

The present invention comprises an upper hollow pipe, a lower hollow pipe and an exterior magnet. On top of the upper hollow pipe is a circuit board. On the circuit board is an Integrated Circuit chip (IC) and a Light Emitting Diode (LED). The upper side of the circuit board is coated with a layer of transparent glue to tightly combine the circuit board with the upper hollow pipe. Inside the upper hollow pipe is a ring of insulating paper. At a lower part of the upper hollow pipe is an exterior pipe thread. Inside the lower hollow pipe is an interior pipe thread. On the bottom of the lower hollow pipe is a magnet. Inside the hollow of the upper and lower hollow pipes are one to three batteries. The exterior pipe thread and the interior pipe thread of the upper and lower hollow pipes are screwed tightly. The exterior magnet is outside the upper and lower hollow pipes independently. In application, the circuit board is in round shape, outside the circuit board could be a transparent plastic body or glass body, which combine the upper hollow pipe tightly. The magnet where outside the upper and lower hollow pipes is optionally replaced by a metal ring installed on the bottom of the lower hollow pipe, forming a ring shape.

Due to the LED installed on the circuit board, makes present invention of light flashing decorative article more fun and interesting. Besides, by tighten up the upper hollow pipe and the lower hollow pipe activates the work of circuit board, which in turn turns on the LED. This function serves as a switch, enabling compact construction and convenient use of the present invention.

DETAILED DESCRIPTION OF PREFERRED EMBODIMENTS

Figure 1:
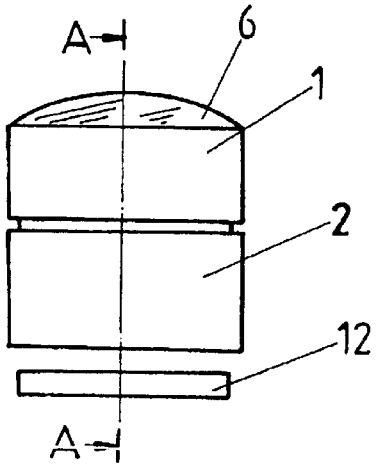
FIG. 1 is a side view of the invention.
Figure 2:
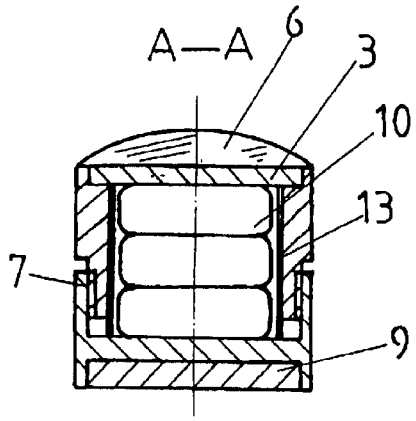
FIG. 2 is a section view of A—A from FIG. 1 without the exterior magnet.
Figure 3:
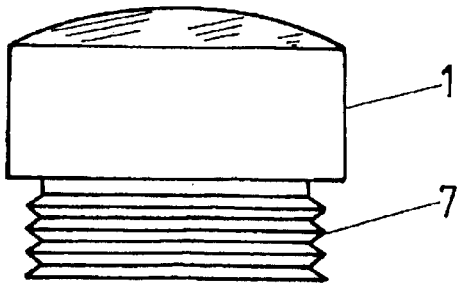
FIG. 3 is a side view of the upper hollow pipe in the invention.
Figure 4:
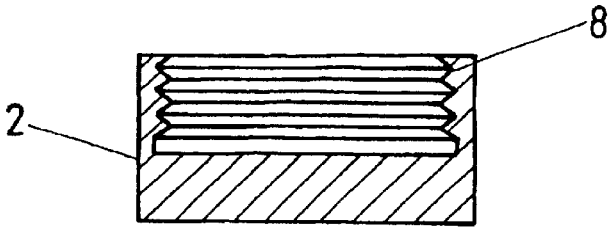
FIG. 4 is a side view of the lower hollow pipe in the invention.

As shown in FIGS. 1 through 5, the present invention comprises an upper hollow pipe 1, a lower hollow pipe 2 and an exterior magnet 12. On the top of the upper hollow pipe 1 is a circuit board 3. On the circuit board 3 are an IC 4 and an LED 5. The upper side of the circuit board 3 is coated with transparent glue 6 to firmly join the circuit board 3 to the upper hollow pipe 1. Inside the upper hollow pipe 1 is a ring of insulating paper 13. At the lower part of the upper hollow pipe 1 is an exterior pipe thread 7. Inside the lower hollow pipe 2 is an interior pipe thread 8. At the bottom of the lower hollow pipe 2 is a magnet 9. Inside the hollow of the upper and lower hollow pipes 1 and 2 are three batteries 10. The exterior pipe thread 7 and the interior pipe thread 8 of the upper and lower hollow pipes 1,2 are joined by matching the threads. The exterior magnet 12 is independently installed on the outside of the upper and lower hollow pipes.

Figure 5:
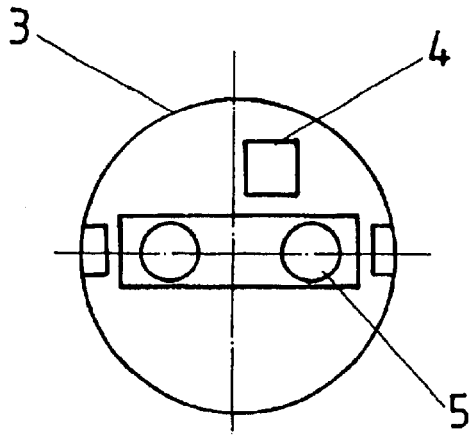
FIG. 5 is a top view of the circuit board in the invention.
Figure 6:
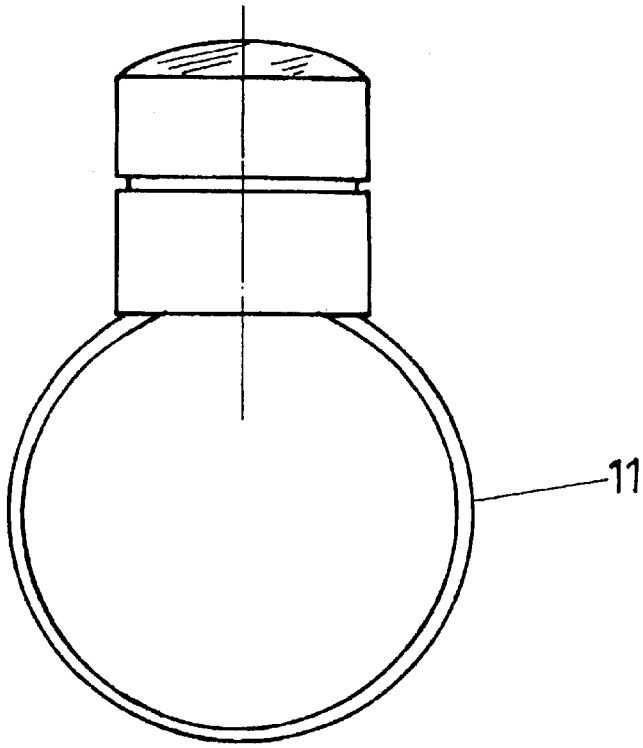
FIG. 6 is a schematic view of an embodiment of the invention.

As shown in FIG. 5, the circuit board 3 is a round shape. Optionally, there is a transparent plastic unit or glass unit on the outside of the circuit board 3 to join firmly with the upper hollow pipe 1. Optionally, the exterior magnet 12 outside the upper and lower hollow pipes 1, 2 is replaced by a metal ring 11 installed on the bottom of the lower hollow pipe 2 (as shown in FIG. 6), forming a ring shape.

By tighten up the upper hollow pipe and the lower hollow pipe activates the work of circuit board, which in turn turns on the LED. This function serves as a switch, enabling compact construction and convenient use of the present invention.

What is claimed is:

1. A innovated flashing decorative article, comprising an upper hollow pipe, a lower hollow pipe and an exterior magnet, on top of said upper hollow pipe being a circuit board, on said circuit board being IC and LED, the upper side of the circuit board being coated with a layer of transparent glue to firmly join the circuit board to the upper hollow pipe, inside the upper hollow pipe being a ring of insulating paper, at a lower part of the upper hollow pipe being an exterior pipe thread, inside the lower hollow pipe being an interior pipe thread, at a bottom of the lower hollow pipe being a magnet, inside the hollow of the upper and lower pipes being one to three batteries, the exterior pipe thread and interior pipe thread of the upper and lower hollow pipes being screwed together, the exterior magnet being independently installed outside of the upper and lower hollow pipes.

2. A innovated flashing decorative article of claim 1, characterized in that, the circuit board is a round shape, and optionally there is a transparent plastic unit or a glass unit for tight fastening purpose to the upper hollow pipe.

3. The innovated flashing decorative article of claim 1, characterized in that, the exterior magnet outside the upper and lower hollow pipes could be optionally replaced by a metal ring attached to a bottom of the lower hollow pipe, thereby forming a ring shape.

* * * * *